US008360137B2

(12) United States Patent
Flender

(10) Patent No.: US 8,360,137 B2
(45) Date of Patent: Jan. 29, 2013

(54) REGENERATIVE HEAT EXCHANGER

(75) Inventor: Manfred Flender, Freudenberg (DE)

(73) Assignee: Balcke-Dürr GmbH, Ratingen (DE)

( * ) Notice: Subject to any disclaimer, the term of this patent is extended or adjusted under 35 U.S.C. 154(b) by 1153 days.

(21) Appl. No.: 12/245,561

(22) Filed: Oct. 3, 2008

(65) Prior Publication Data

US 2009/0139694 A1 Jun. 4, 2009

(30) Foreign Application Priority Data

Oct. 17, 2007 (EP) ..... 07020309

(51) Int. Cl.

| | |
|---|---|
| ***F28D 17/00*** | (2006.01) |
| ***F23L 15/02*** | (2006.01) |
| ***F28G 1/12*** | (2006.01) |
| ***B08B 3/00*** | (2006.01) |
| ***B08B 3/04*** | (2006.01) |

(52) U.S. Cl. ..... 165/5; 165/7; 165/8; 165/95; 134/90; 134/105; 134/181; 239/128

(58) Field of Classification Search ..... 165/5, 7, 165/8, 10, 95; 134/90, 105, 181; 239/13, 239/128, 133

See application file for complete search history.

(56) References Cited

U.S. PATENT DOCUMENTS

| | | | | | |
|---|---|---|---|---|---|
| 2,355,021 | A | * | 8/1944 | Waitkus | 165/5 |
| 2,761,653 | A | * | 9/1956 | Grames et al. | 165/5 |
| 3,997,294 | A | * | 12/1976 | Kritzler | 165/7 |
| 4,025,362 | A | * | 5/1977 | Frauenfeld | 165/95 |
| 4,256,511 | A | * | 3/1981 | Atchison et al. | 134/181 |
| 4,376,443 | A | * | 3/1983 | Mondy, Jr. | 134/181 |
| 4,402,104 | A | * | 9/1983 | Olesovsky et al. | 134/181 |
| 4,513,807 | A | * | 4/1985 | Rose et al. | 165/10 |
| 4,705,057 | A | * | 11/1987 | Mohr et al. | 165/95 |
| 4,815,523 | A | * | 3/1989 | Dehli et al. | 165/5 |
| 5,044,424 | A | * | 9/1991 | Monro | 165/5 |
| 5,097,889 | A | * | 3/1992 | Ritter | 165/5 |
| 5,366,561 | A | | 11/1994 | Ginn | |
| 5,368,091 | A | * | 11/1994 | Seebald et al. | 165/5 |
| 5,875,833 | A | * | 3/1999 | Schluter | 165/5 |
| 5,924,478 | A | * | 7/1999 | Crocker | 165/95 |
| 6,065,528 | A | | 5/2000 | Fierle et al. | |

FOREIGN PATENT DOCUMENTS

| | | | |
|---|---|---|---|
| DE | 3619396 | A1 | 12/1986 |
| DE | 4442055 | A1 | 5/1996 |
| DE | 44 42 055 | A1 | 10/2008 |
| JP | 09133495 | A | 5/1997 |

* cited by examiner

*Primary Examiner* — Ljiljana Ciric
(74) *Attorney, Agent, or Firm* — Baker & Hostetler LLP

(57) ABSTRACT

A regenerative heat exchanger is disclosed and described for gas streams that perform heat exchange between one another using a buffer that is continuously immersed in the gas streams. The buffer is cleanable by a pivotable blowing arm that uses spray nozzles to clean the buffer. The blowing arm has an axis that is positioned parallel to the flow direction of the gas streams across the buffer and allows for the use of two blowing arms which extend in a mirror image opposite to one another. The spray nozzles each distribute compressed air and/or pressurized water.

9 Claims, 2 Drawing Sheets

REGENERATIVE HEAT EXCHANGER

CROSS-REFERENCE TO RELATED APPLICATIONS

This application claims benefit to the filing of EP 07020309.6 filed Oct. 17, 2007, the entire contents of which is incorporated by reference herein.

FIELD OF THE INVENTION

The invention relates to a regenerative heat exchanger for gas streams in heat exchange with one another, the heat exchange occurring via a buffer continuously immersed in all participating gas streams, which is cleanable by a pivotable blowing arm carrying spray nozzles on its free end, a bearing axis of the blowing arm being situated parallel to the flow direction of the gas streams in the area of the buffer and its imaginary extension penetrating the buffer.

In heat processes in industrial facilities, large quantities of exhaust gas having significant heat content frequently arise, whose reclamation provides economic advantages in the event of generally rising energy costs. This is often the case, for example, in electricity generation, in chemical processes, or also in food processing. To reclaim heat from exhaust gas, it is conducted in counter flow to a fresh air flow through a buffer, for example, which has the form of a slowly rotating disc. This buffer absorbs heat from the exhaust gas on one side and heats a cooler gas stream, such as combustion air, on its other side using this heat.

The buffer is unavoidably contaminated, so that its effectiveness decreases. It is accordingly necessary to clean the buffer from time to time. This is performed, for example, according to DE 44 42 055 A1, FIG. 4, using a pivot arm which is shorter than the radius of the buffer. The pivot arm carries nozzles directed toward the buffer on its free end. These nozzles spray cleaning liquid onto the hot surfaces of the buffer in the flow direction of the exhaust gas, so that contaminants are detached and washed away.

It is disadvantageous that the upstream-directed buffer side is cleaned and washed, but the washing occurs on one side, so that already detached contaminants may accumulate again at another point. This also may not be reliably prevented by a second pivot arm situated at another point, because this second pivot arm acts with significant time delay as a result of the slow rotation of the buffer.

SUMMARY OF THE INVENTION

The invention is therefore based on the object of ensuring reliable removal of contaminants from the area of the buffer and thus allowing the greatest possible time interval between sequential washings.

This object is achieved according to the invention in that two blowing arms situated in a mirror image to the buffer are each provided with at least one nozzle each for compressed air and for pressurized water. Contaminants detached from the buffer upstream in the gas stream are thus driven reliably out of this area by washing jets from nozzles lying downstream of the buffer.

For protection against corrosion, the bearings of the blowing arms are advantageously situated encapsulated from the participating gas streams between the outside edge of the disc-shaped buffer and its central axis. The distance of the bearings from the outside edge of the buffer is expediently significantly less than the distance from its central axis and the bearings of the two blowing arms are thus aligned with one another. This bearing configuration results in short blowing arms and thus also only results in well controllable bearing forces in the event of high pressures of compressed air and pressurized water, even with significant recoil forces at the nozzles.

The supply channels for washing agent to the nozzles are expediently situated concentrically to one another and the blowing arms are tapered step-by-step in the direction toward their free end.

A part of the blowing arms angled axially-parallel to the flow direction of the gas streams is expediently used for guiding them in two bearings. The bearings are advantageously implemented as roller bearings and the maximum deflections of the blowing arms guide their free ends up to the outside and inside edges of the buffer.

On one hand good cleaning and, in addition, more secure disposal of dissolved contaminants is ensured and a greater time interval between sequential cleaning processes is made possible by the mirror-image configuration of two blowing arms.

BRIEF DESCRIPTION OF THE DRAWINGS

An exemplary embodiment of a regenerative heat exchanger is shown in a drawing. In the figures.

DETAILED DESCRIPTION OF THE DRAWINGS

Figure 1:
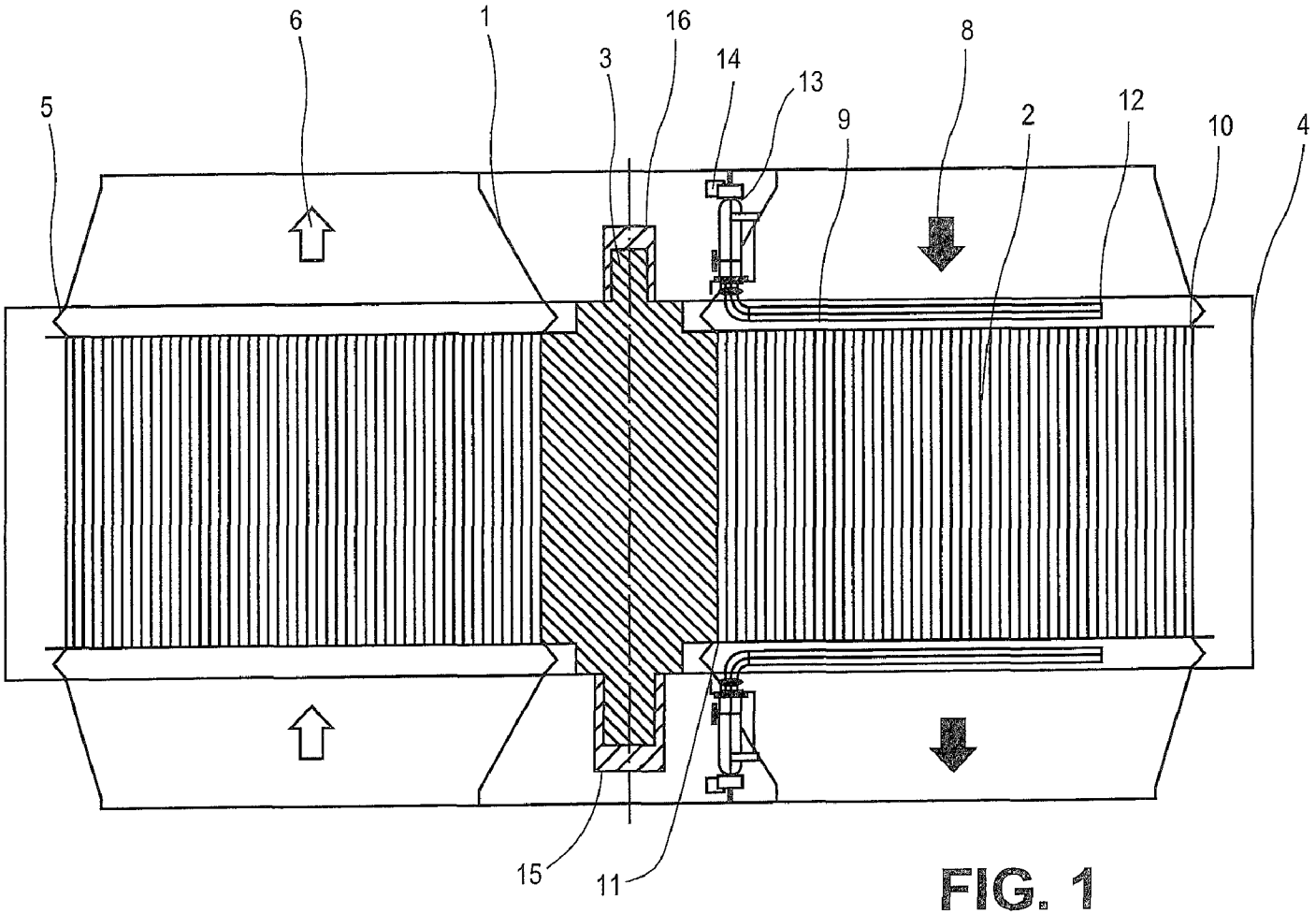
FIG. 1 shows a section.
Figure 2:
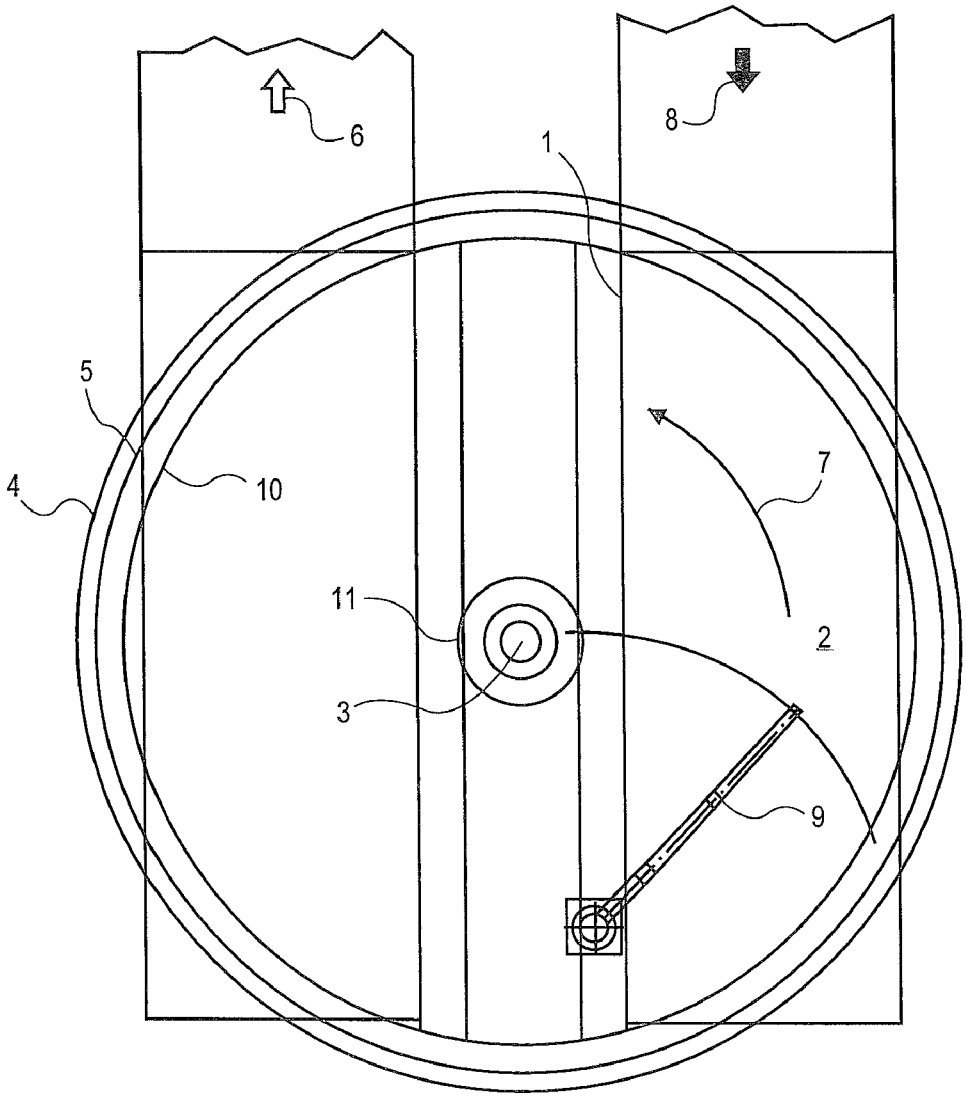
FIG. 2 shows a top view without the upper channel sections for the gas streams.

A frame 1 comprises a buffer 2, which is mounted so it is rotatable in the frame 1 via a shaft 3. A housing 4 envelops the buffer 2 and is sealed around its entire circumference in relation thereto by sealing lips 5. The part of the buffer 2 lying on the left in the drawing has a hot gas stream 6 flowing through it from bottom to top, so that the section of the buffer 2 lying in this part is heated in each case.

The buffer 2 is rotated slowly in the direction of an arrow 7 in a way not shown in greater detail, so that the heated part of the buffer 2 slowly travels into the part of the housing 4 lying on the right in the drawing. This part of the housing 4 has a cold gas stream 8 passing through it from top to bottom, to which the buffer 2 dissipates the heat absorbed from the gas stream 6, so that the now heated gas stream 8 may be supplied to a furnace, for example, as combustion air. The cooled section of the buffer 2 travels further and again absorbs heat from the gas stream 6 in the part of the housing 4 lying on the left and a new cycle of the heat exchange begins.

The buffer 2 is essentially assembled from lamellae made of a material having good heat conductivity (not shown in detail) situated parallel to the gas streams 6 and 8 and only offers the gas streams 6 and 8 a very slight resistance. Nonetheless, the buffer 2 is contaminated in operation, so that its heat absorption and its capability to dissipate heat again are impaired. The necessity thus results of cleaning the buffer 2 during operation at periodic intervals. Blowing arms 9 are provided for this purpose, which are pivotable back-and-forth having their free ends between the outside edge 10 and inside edge 11 of the buffer 2.

The blowing arms 9 carry nozzles 12 on their free ends. Thus, for example, two nozzle plates 12 are provided at the end of the blowing arms 9 situated on the intake side for the gas stream 6, one low-pressure nozzle plate and one high-pressure nozzle plate. A low-pressure nozzle plate is suitable for steam, compressed air, and water. A high-pressure nozzle plate is suitable for water. In this manner, practically all contaminants occurring in normal operation may be detached, washed away, and possibly also pulverized. These contaminants are then carried along transversely through the buffer 2, the nozzles 12 provided on the outlet side of the buffer 2 on the second blowing arm reliably preventing the contaminants from accumulating again. Nozzles may be situated identically on both sides on the blowing arms.

The two blowing arms 9 having their nozzles 12 situated in a mirror image above and below the buffer 2 clean the surface of the elements forming the buffer 2, so that their effectiveness is reproduced without an operational interruption. The detached contaminants are also carried along after the exit from the buffer 2 and are separated from the exhaust gas if necessary in a downstream filter and disposed of without damage to the environment.

To ensure removal of encrusted contaminants as well, pressurized water at up to several hundred bar is used, so that a significant recoil force occurs at the nozzle 12 for pressurized water. Bearings 13 are provided at a bearing distance from one another to safely absorb this force and simultaneously prevent jamming of the blowing arm 9.

Regenerative heat exchangers 2 of the type according to the invention are usable in practically all facilities from which a heated exhaust gas is exhausted to the environment. Heat exchangers 2 of this type allow reclamation of heat energy and are simultaneously expedient as an attachment points for filters. In addition to an economic profit, they also allow protection of the environment.

What is claimed is:

1. A regenerative heat exchanger for exchanging heat between two flowing gas streams, comprising:

a disc shaped buffer, wherein said buffer provides heat exchange between the two gas streams;

a first pivotable blowing arm and a second pivotable blowing arm, each blowing arm having a free end that cleans said buffer, each blowing arm comprising:

a plurality of spray nozzles disposed on said free end;

a bearing axis positioned axially parallel to the direction of flow of the gas streams over said buffer, wherein the buffer forms an axis of symmetry for the first and second blowing arms such that said blowing arms lie in a mirror image opposite to one another, wherein at least one of said plurality of nozzles provides compressed air and pressurized water.

2. The regenerative heat exchanger according to claim 1, wherein the axes of bearings of the blowing aims lie a distance between the outside edge of the disc-shaped buffer and its central axis, encapsulated from the two gas streams.

3. The regenerative heat exchanger according to claim 2, wherein the distance of the bearings from the outer edge of the buffer is significantly less than the distance from its central axis.

4. The regenerative heat exchanger according to claim 3, wherein the axes of the bearings of the two blowing arms are aligned with one another.

5. The regenerative heat exchanger according to claim 4, wherein a portion of each of said blowing arms is angled axially-parallel to the direction of flow of the gas streams wherein said angled portions is provided by two bearings.

6. The regenerative heat exchanger according to claim 5, wherein the bearings are roller bearings.

7. The regenerative heat exchanger according to claim 1, further comprising supply channels within the blowing arms to the nozzles are arrange concentrically to one another.

8. The regenerative heat exchanger according to claim 7, wherein the blowing arms gradually taper off toward said free end.

9. The generative heat exchanger according to claim 8, characterized in that a supply channel for pressurized water is arranged concentrically in the blowing arm.

* * * * *